United States Patent [19]

Blanchard

[11] Patent Number: 5,035,014

[45] Date of Patent: Jul. 30, 1991

[54] COMFORT GUARD FOR LOW AIR LOSS PATIENT SUPPORT SYSTEMS

[75] Inventor: Frederick W. Blanchard, North Charleston, S.C.

[73] Assignee: SSI Medical Services, Inc., Charleston, S.C.

[21] Appl. No.: 566,081

[22] Filed: Aug. 10, 1990

[51] Int. Cl.[5] ..... A47C 21/08; A61G 7/00

[52] U.S. Cl. ..... 5/424; 5/474; 5/508

[58] Field of Search ..... 5/61, 193, 400, 424, 5/425, 427, 431, 474, 491, 508

[56] References Cited

U.S. PATENT DOCUMENTS

| | | | |
|---|---|---|---|
| 2,644,173 | 7/1953 | James | 5/425 |
| 3,148,387 | 9/1964 | Sarnie, Jr. et al. | 5/431 |
| 3,619,824 | 11/1971 | Doyle | 5/424 X |
| 4,437,704 | 3/1984 | Hovsepians | 5/491 X |
| 4,607,402 | 8/1986 | Pollard | 5/925 |
| 4,654,903 | 4/1987 | Chubb et al. | 5/61 |
| 4,745,647 | 5/1988 | Goodwin . | |
| 4,768,249 | 9/1988 | Goodwin . | |
| 4,827,545 | 5/1989 | Arp | 5/424 |
| 4,872,228 | 10/1989 | Bishop | 5/425 |

*Primary Examiner*—Michael F. Trettel

*Attorney, Agent, or Firm*—Dority & Manning

[57] ABSTRACT

A patient comfort apparatus is provided to be used with a low air loss patient support system. An elongated cylindrical member defines a resiliently deformable member surrounded by a cover defining a flexible web that is impervious to liquid. The cover defines a slit which provides access to the interior of the cover and permits insertion and withdrawal of the elongated cylindrical member. A closure mechanism such as a zipper is provided for the slit in the cover. An encasement member is provided between the cover and the cylindrical member and includes an antibacterial agent. The cover further defines an attachment flange that is connected to the cover via a flexible hinge. The attachment flange defines a plurality of holes along its length. The holes provide sites for attaching the flange to the low air loss patient support system. One end of the comfort apparatus is formed at a bias to the longitudinal axis of the cylindrical member. An appendage is provided for disposition adjacent to the elongated cylindrical member at a position intermediate along the length of the elongated cylindrical member. Provision is made in the cover to surround the appendage as well as the elongated cylindrical member.

22 Claims, 4 Drawing Sheets

COMFORT GUARD FOR LOW AIR LOSS PATIENT SUPPORT SYSTEMS

BACKGROUND OF THE INVENTION

The present invention relates to low air loss patient support systems and more particularly to auxiliary apparatus for same.

Examples of low air loss patient support systems are disclosed in U.S. Pat. Nos. 4,745,647 to Goodwin and 4,768,249 to Goodwin, which are hereby incorporated herein by reference. Such systems have a plurality of sacks inflated with air at relatively low pressures. A patient is supported by the upper surfaces of these sacks, which are deformable by the body of the patient. Typically, the inflated sacks are deployed on a frame which is articulatable in one or more sections to reconfigure the posture of the patient. Such systems also typically include side guards which can be raised and lowered along both longitudinal sides of the patient support surface. A patient resting near the ends of the sacks near the side guards can deform the sacks and form a crevice between the deformed ends of the sacks and the side guards. Depending upon the vitality of the patient, some patients can only extract themselves from such positions with difficulty. Moreover, the process of such extraction can require exertion that undesirably expends energy of the patient.

OBJECTS AND SUMMARY OF THE INVENTION

It is a principal object of the present invention to provide an apparatus that guards against a patient wedging himself or herself between the ends of inflated support sacks and side rails of low air loss patient support systems.

Another principal object of the present invention is to provide an apparatus that guards against a patient wedging himself or herself between the ends of inflated support sacks and side rails of low air loss patient support systems, wherein the apparatus is readily removably attachable to the patient support system without requiring modification of the patient support system.

Still another principal object of the present invention is to provide an apparatus that guards against a patient wedging himself or herself between the ends of inflated support sacks and side rails of low air loss patient support systems, wherein the apparatus automatically deploys itself when the side rails are raised.

A further principal object of the present invention is to provide an apparatus that guards against a patient wedging himself or herself between the ends of inflated support sacks and side rails of low air loss patient support systems, wherein the apparatus does not hinder patient transfers to and from the patient support system.

Yet another principal object of the present invention is to provide an apparatus that guards against a patient wedging himself or herself between the ends of inflated support sacks and side rails of low air loss patient support systems, wherein the apparatus automatically moves away from and below the patient support surface when the side rails are lowered.

A still further principal object of the present invention is to provide an apparatus that guards against a patient wedging himself or herself between the ends of inflated support sacks and side rails of low air loss patient support systems, wherein the apparatus continues to perform its guarding function while the patient support system is articulating and remains in the articulated configuration.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a patient comfort apparatus is provided to be used with a low air loss patient support system having a plurality of inflatable sacks, an articulatable frame which supports and carries the sacks, side rails which can be raised into a position where the side rails rest against the ends of sacks, a plurality of side panels provided along each side of patient support system, a head section with a headboard, and a foot section with a footboard. The patient comfort apparatus of the present invention preferably comprises an elongated cylindrical member having a first longitudinal axis which extends along the length of cylindrical member and a transverse axis defined perpendicularly to the first longitudinal axis. As embodied herein, the elongated cylindrical member preferably defines a resiliently deformable member. Accordingly, elongated cylindrical member preferably is formed of extruded polyurethane or other high density high molecular weight foam material. The elongated cylindrical member can define any of a number of transverse cross-sectional shapes, including an oval or a circle. However, the symmetry of the transverse cross-sectional area preferably extends longitudinally in one direction, such as the oval. Such types of symmetry provide greater rigidity in the direction which will be disposed vertically when the patient comfort apparatus is in the deployed position. The elongated cylindrical member can be completely hollow, or can define an elongated cylindrical cavity extending longitudinally through at least a portion of its length. The transverse cross-sectional area of the cavity can be circular or can be generally rectangular with the short ends being arcuate. The elongated cylindrical member can further define an elongated solid member that is configured and disposed to fill any elongated cylindrical cavity, thus rendering the elongated cylindrical member solid in effect. Preferably, any solid member completely fills the cavity along the entire length of the cavity and is formed of the same material that is used to form elongated cylindrical member. However, the solid member can be formed of a material that has a slightly different deformation characteristic so as to be more or less deformable or flexible than the elongated cylindrical member.

In further accordance with the present invention, one end of the deformable member that defines the elongated cylindrical member preferably defines a partially biased surface. As embodied herein, the partially biased surface is formed in the end of the elongated cylindrical member that is intended to be disposed near the headboard of the patient support system. The partially biased surface enables the vertical ribs of the side rail to slip past the truncated circular surface which exists at the extreme free end of the elongated cylindrical member. The plane which contains the partially biased surface extends at an acute angle from the plane which contains the transverse cross-section of the elongated cylindrical member. This angle preferably is approximately 35°. The end of the elongated cylindrical member that defines the partially biased surface also further defines an extreme end portion, which is shaped as a partial circular surface.

In further accordance with the patient comfort apparatus of the present invention, the elongated cylindrical member can define an appendage which extends from the elongated cylindrical member in a direction transversely to the longitudinal axis of the elongated cylindrical member. The appendage preferably extends along substantially less than the full length of the elongated cylindrical member. In one embodiment of the present invention, a truncated cylindrical member is provided and disposed adjacent to but separate from the elongated cylindrical member. Otherwise, the appendage preferably defines a truncated cylindrical member which is integral with the elongated cylindrical member. Moreover, in another alternative embodiment, the truncated member and the elongated cylindrical member to which it is appended, can be formed as a unitary structure. As embodied herein, the truncated member defines a second longitudinal axis extending along the length of the truncated member and preferably disposed in a direction parallel to the longitudinal axis of the cylindrical member. Furthermore, a second transverse axis extends perpendicular to the second longitudinal axis of the truncated member. The truncated member preferably defines a second resiliently deformable member, which can be formed of the same material that is used to form the elongated cylindrical member. The truncated member can define a circular transverse cross-sectional area over its entire length. Alternatively, the truncated member can define an oval-shaped transverse cross-sectional shape over the entire length of the truncated member. Other transverse cross-sectional shapes for the truncated member also can be provided. However, like the elongated cylindrical member, it is preferred to provide a transverse cross-sectional shape having a linear axis of symmetry in one direction, such as the oval shape. The major axis of the oval is the desired linear axis of symmetry. Moreover, the truncated member can define an elongated cylindrical cavity extending longitudinally through at least a portion of the length of the second resiliently deformable member. Furthermore, the truncated member can define an elongated solid member that is configured and disposed to fill at least a portion of the elongated cylindrical cavity.

The truncated member preferably is disposed at a position intermediate along the length of an adjacently disposed elongated cylindrical member. Moreover, the truncated member preferably is disposed at a position along the length of the elongated cylindrical member so as to be in the immediate vicinity where the frame of the patient support system articulates. In this way, the truncated member provides an extra buffer to prevent a patient from inserting a limb into the space that can exist between the diagonal ends of adjacent raised side rails.

In still further accordance with the present invention, an outer cover is provided. As embodied herein, a cover surrounds the elongated cylindrical member and the truncated member by defining a cavity for receiving the elongated cylindrical member and the truncated member within the cover. The cover is impervious to liquid and preferably is formed as a flexible web of polyurethane coated nylon web material. The cover preferably defines the outermost covering of the elongated cylindrical member and the adjacently disposed truncated member. The cover preferably defines a continuous flexible web that is shaped to conform closely to the shapes of the outer profiles of the adjacently disposed elongated cylindrical member and truncated member that are received within the cavity defined by the cover.

In yet further accordance with the present invention, means are provided for connecting the elongated cylindrical member to the patient support system. As embodied herein, the means for connecting the elongated cylindrical member to the patient support system preferably includes an attachment flange mounted lengthwise along the cover. Preferably, the attachment flange and the cover define a unitary member. Furthermore, the attachment flange preferably defines a plurality of holes spaced apart along its length. The circumference of the holes is preferably not reinforced by a metal ring or other rigid reinforcing material. Such rigid materials could prove discomfortable or injurious to a patient. In addition, the attachment flange preferably defines a flexible hinge portion that is disposed between the cover and the portion of the flange through which the holes are defined. Thus, the attachment flange provides means for attaching the cover to the patient support system.

In further accordance with the present invention, means are provided for gaining access into the cavity of the cover. As embodied herein, the means for gaining access into the cavity of the cover includes an access opening defined in the cover. A separate access opening can be defined for each of the elongated cylindrical member and the truncated member. Each such access opening respectively permits selective insertion and withdrawal of an elongated cylindrical member and a truncated member. Each such access opening defines a slit formed through the cover and is surrounded by a closure mechanism that is mounted about the access opening. The closure mechanisms permit selective access to the respective access openings. The closure mechanisms are configured to be impervious to liquid when they are closed. Suitable closure mechanisms include a zipper or a hook and loop fastener mechanism. In embodiments which include a unitary or integrated appendage forming the truncated member, a single access opening can suffice to permit selective insertion and withdrawal of such embodiment of the elongated cylindrical member.

In still further accordance with the present invention, a protective envelope is provided. As embodied herein, a protective envelope is disposed between the cover and the elongated cylindrical member. The protective envelope defines an encasement member that completely surrounds the elongated cylindrical member. In embodiments in which the truncated member defines an appendage that is unitary or integral with the elongated cylindrical member, the protective envelope also encompasses this appendage. However, in embodiments in which the truncated member defines a separate member from the elongated cylindrical member, a second protective envelope can be provided to surround only the truncated cylindrical member. The second protective envelope accordingly would form a skin tight fit around the truncated cylindrical member and be disposed between the truncated cylindrical member and the cover. Alternatively, the protective envelope can be configured to surround both the elongated cylindrical member and a separately defined truncated member that is disposed adjacently with respect to the elongated cylindrical member. Each protective envelope preferably defines a flexible continuous sheet of laminate vinyl-synthetic fabric that is wrapped tightly around the elongated cylindrical member and/or the truncated cylindrical member so as to conform closely to the shape(s) of the outer surfaces of such member(s) and includes an antibacterial agent.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
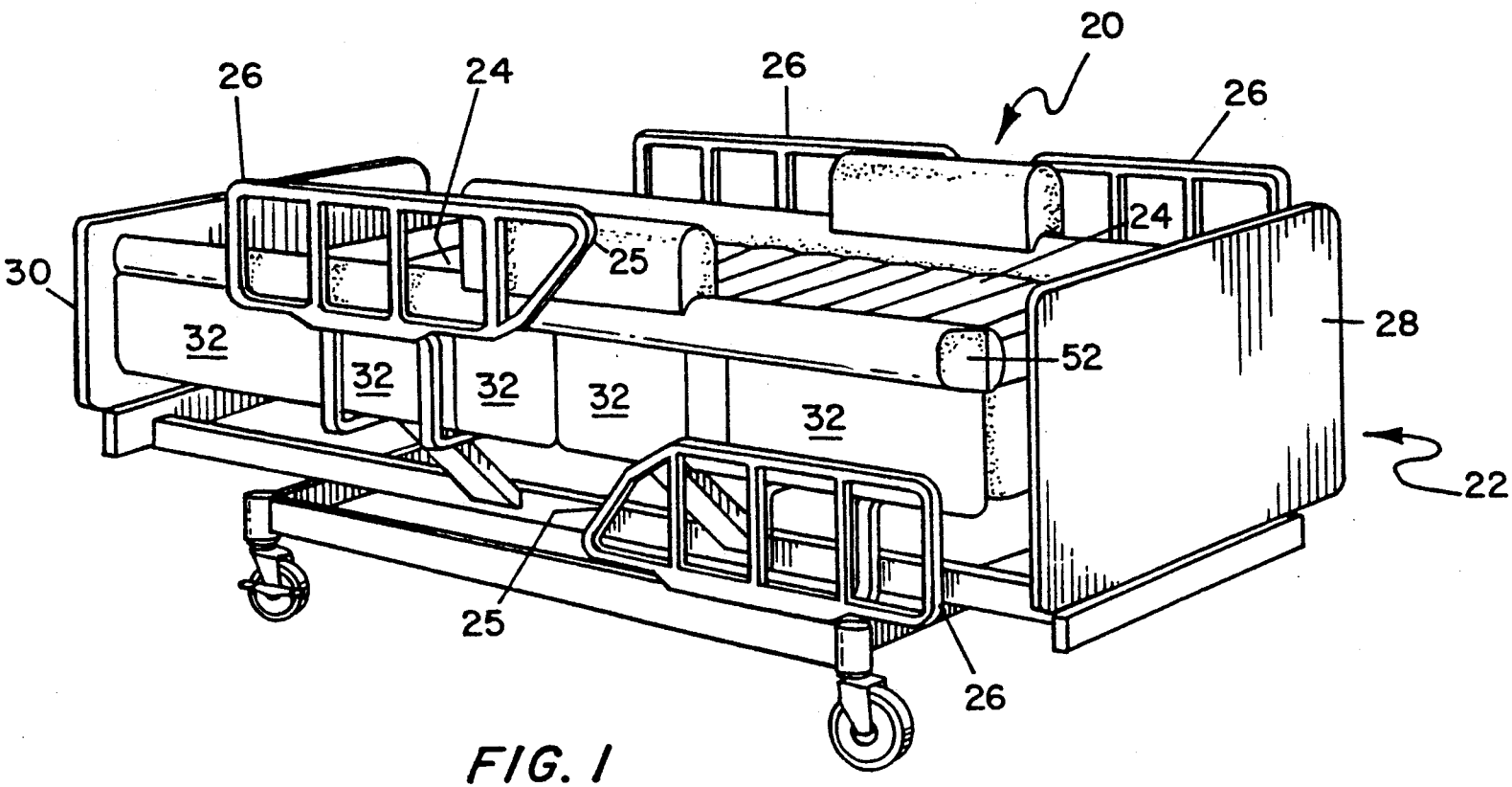
FIG. 1 illustrates an elevated perspective view of an embodiment of the present invention in use on a low air loss patient support system.

A preferred embodiment of the patient comfort apparatus of the present invention is shown in FIG. 1, where it is generally designated by the numeral 20, in use with a low air loss patient support system, which is generally designated by the numeral 22. A headboard 28 is provided at the head section of patient support system 22. A foot board 30 is provided at the foot of patient support system 22. Patient support system 22 includes a plurality of inflatable sacks 24, the upper surfaces of which can be seen in FIG. 1. Patient support system 22 also includes side rails 26 which can be raised into a position where side rails 26 rest against the ends of sacks 24. Two side rails 26 are provided on each side of patient support system 22. Each side rail 26 can be raised and lowered, selectively, separately from each other side rail 26.

As shown in FIG. 1 for example, a plurality of side panels 32 are provided along each side of patient support system 22. The embodiment of patient support system 22 shown in FIGS. 1 and 2 has an articulatable frame which supports and carries sacks 24. As shown in FIG. 3 for example, each side panel 32 is a flexible sheet of material which has fastening means such as snaps 34 which are received and fastened to mating snap fixtures 36 on the ends of each sack 24 and along the side edge of each section of articulatable frame 38 of patient support system 22.

Figure 2:
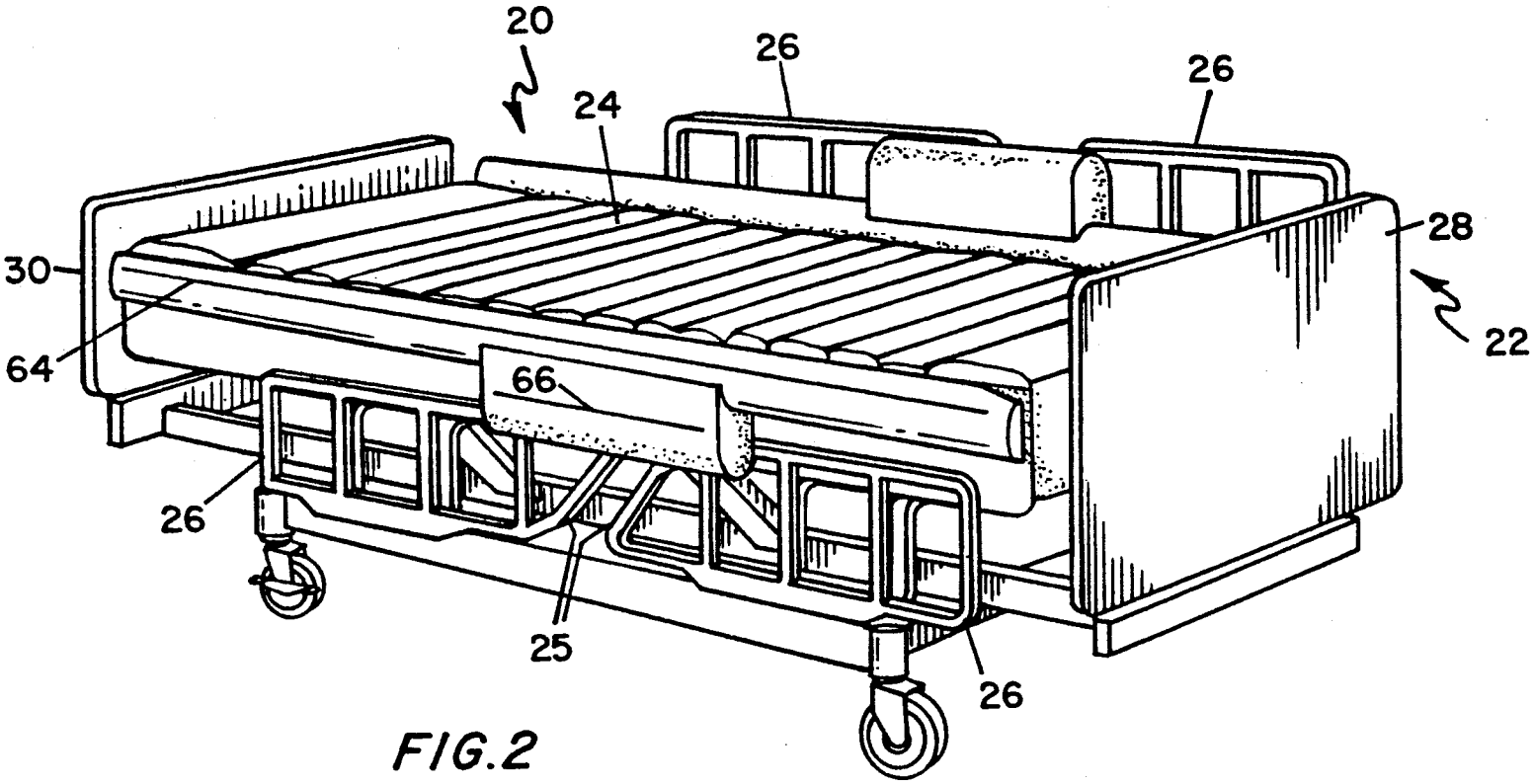
FIG. 2 illustrates an elevated perspective view of an embodiment of the present invention in a different configuration in use on a low air loss patient support system.
Figure 3:
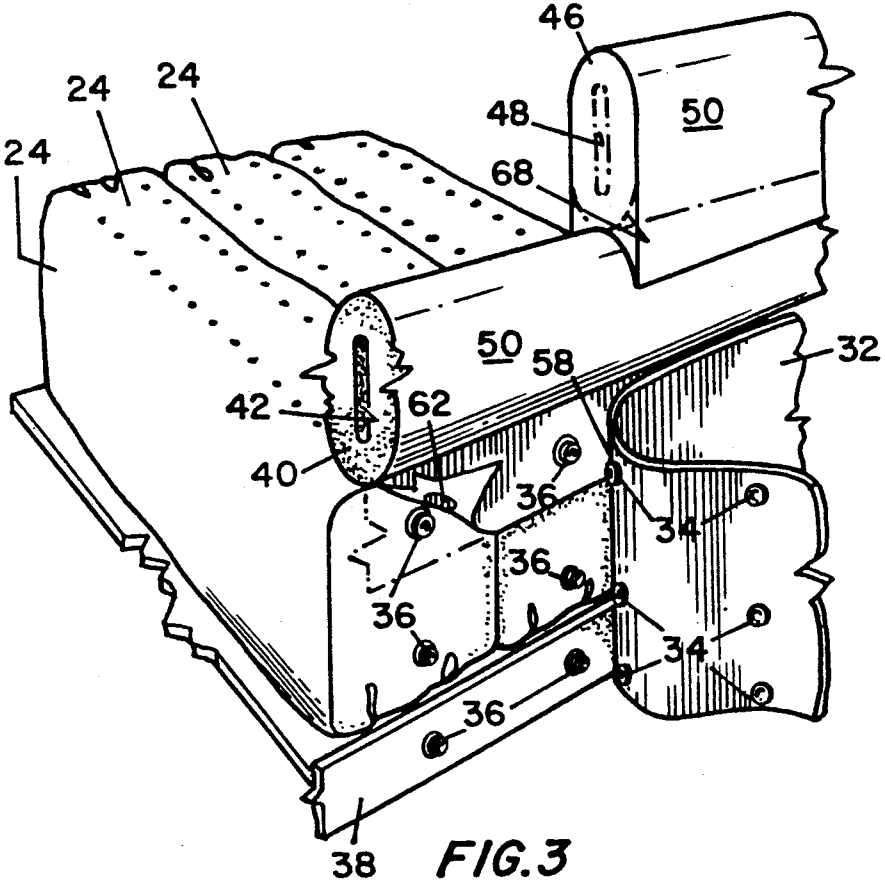
FIG. 3 illustrates a partial elevated perspective view of an embodiment of the apparatus of the present invention being installed on a low air loss patient support system.

As shown in FIGS. 1 and 2 for example, one end of each side rail is configured with a diagonal rail 25, and each side rail is disposed so that its diagonal rail 25 faces the other side rail on the same side of patient support system 22. When patient support system 22 articulates, the diagonal rail configuration of the opposed ends of side rails 26 on each side of the patient support system avoid contact with one another while continuing to provide a structure which functions to prevent the patient from sliding off the edge of sacks 24 (assuming that the side rail is in the raised position).

As shown in FIGS. 1 and 2 for example, a separate patient comfort apparatus 20 is provided for each elongated side of patient support system 22. As shown in FIG. 1 for example, when at least one side rail 26 is deployed in the raised position, the patient comfort apparatus also is deployed in the raised position, which is a position that extends patient comfort apparatus 20 above the upper surfaces of sacks 24. The lowered side rail shown in FIG. 1 is one of two head section side rails of patient support system 22 and is located closer to headboard 28 than foot board 30. As shown in FIG. 2 for example, when both side rails 26 on one side of patient support system 22 have been lowered, the patient comfort apparatus on the same side of patient support system 22 is retracted so as not to extend above the upper surfaces of sacks 24.

Figure 4:
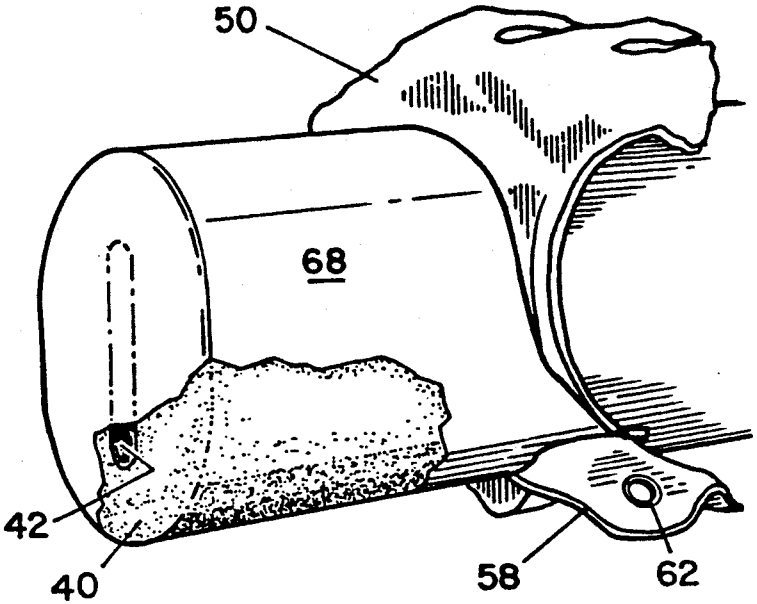
FIG. 4 illustrates an elevated partial perspective view of an embodiment of the present invention with components peeled away to illustrate several components of this embodiment.
Figure 5:
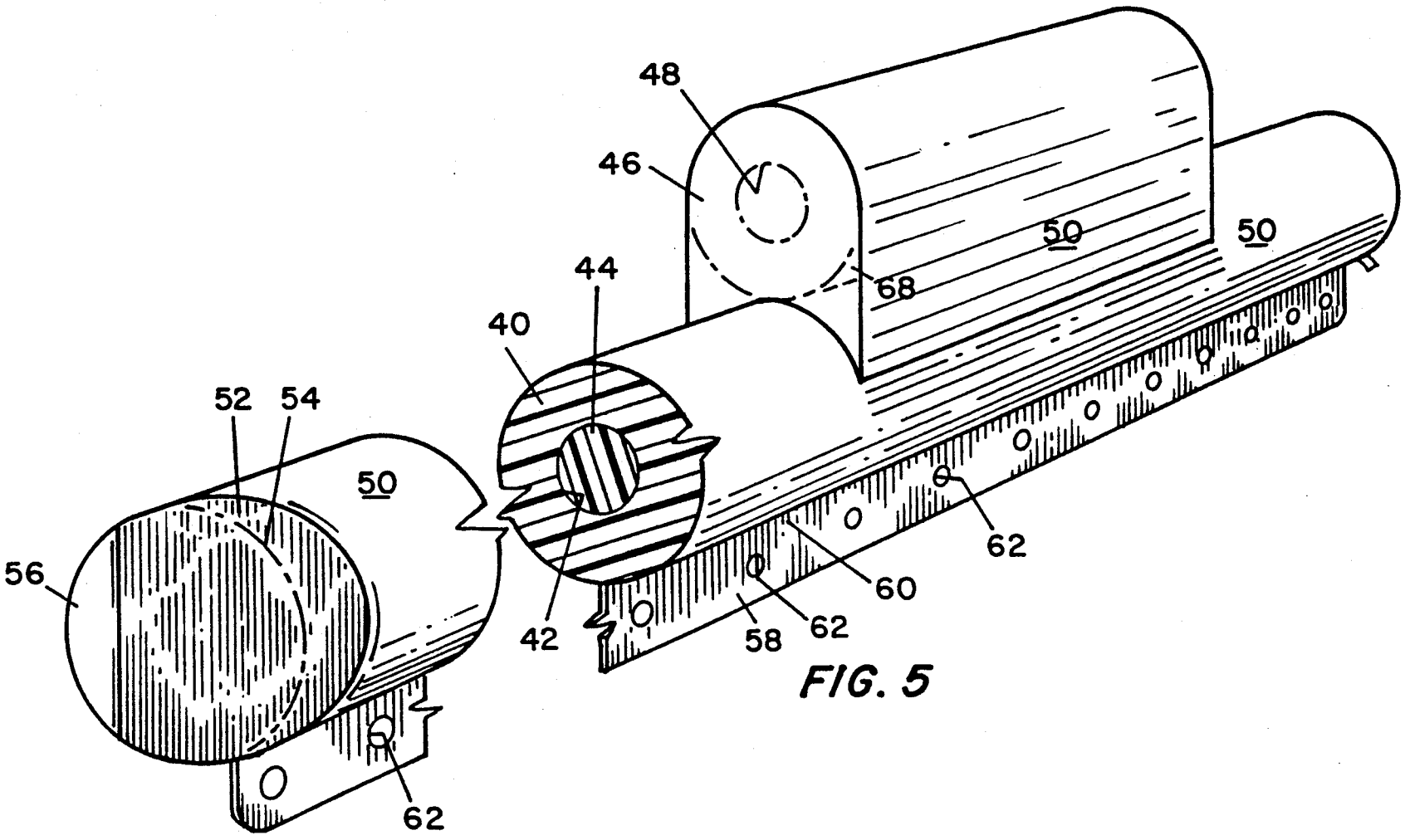
FIG. 5 illustrates an elevated partial perspective view of an embodiment of the present invention with portions broken and shown in phantom by dashed lines.

In accordance with the patient comfort apparatus of the present invention, an elongated cylindrical member is provided. As embodied herein and shown in FIG. 5 for example, an elongated cylindrical member 40 is shown in a broken view in a circular transverse cross-sectional embodiment. Elongated cylindrical member 40 preferably defines a resiliently deformable member. Accordingly, elongated cylindrical member preferably is formed of extruded polyurethane or other high density high molecular foam material. A skinned open cell high density material such as RUBATEX TM, available from *Rubatex Company of Bedford, VA.* has been found satisfactory. Elongated cylindrical member 40 defines a first longitudinal axis which extends along the length of cylindrical member 40. Moreover, a transverse axis is defined perpendicular to the first longitudinal axis of cylindrical member 40. As shown in FIGS. 3 and 4 for example, elongated cylindrical member 40 has a transverse cross-section shaped as an oval. Other transverse cross-sectional shapes can be provided. However, the symmetry of the transverse cross-sectional area preferably extends longitudinally in one direction, such as the oval shown in FIG. 4 for example. Such types of symmetry provide greater rigidity in the direction which will be disposed vertically when in the deployed position, which position is shown in FIG. 1 for example. Elongated cylindrical member 40 can be hollow as shown in FIGS. 3 and 4 for example. Moreover, as shown in FIG. 5 for example, elongated cylindrical member 40 can define an elongated cylindrical cavity 42 extending longitudinally through at least a portion of the length of cylindrical member 40. As shown in FIG. 5 for example, the transverse cross-sectional area of cavity 42 can be circular. As shown in FIGS. 3 and 4 for example, the transverse cross-sectional shape of cavity 42 can be generally rectangular with the short ends being arcuate. As shown in FIG. 5 for example, elongated cylindrical member 40 can further define an elongated solid member 44 that is configured and disposed to fill elongated cylindrical cavity 42, thus rendering elongated cylindrical member 40 solid in effect. Preferably, solid member 44 completely fills cavity 42 along the entire length of cavity 42 and is formed of the same material that is used to form elongated cylindrical member 40. However, solid member 44 can be formed of a material that has a slightly different deformation characteristic so as to be more or less deformable or flexible than elongated cylindrical member 40. For example, if the material forming elongated cylindrical member 40 is highly deformable and it is desired to reduce the deformability of cylindrical member 40, then solid member 44 would be formed of a material with deformation characteristics that are less than the material forming elongated cylindrical member 40. Moreover, the converse of this situation also would apply, and solid member 44 could be formed of material that was more highly deformable than cylindrical member 40. Furthermore, as shown in FIGS. 3 and 4 for example, another way to increase the deformability of elongated cylindrical member 40 is to leave elongated cavity 42 empty.

As the side rail near the headboard moves from the lowered position shown in FIG. 2 to the raised position shown in the background of FIG. 1, the side rail moves in a generally counterclockwise direction. In so doing, the vertical ribs that define side rail 26 might become entangled with the end of patient comfort apparatus 20 that terminates near headboard 28. To avoid this entanglement problem, in further accordance with the present invention, one end of the deformable member that defines the elongated cylindrical member preferably defines a partially biased surface. As embodied herein and shown in FIGS. 5, 1, and 2 for example, elongated cylindrical member 40 has one end defining a partially biased surface 52. Partially biased surface 52 is formed in the end of elongated cylindrical member 40 that is intended to be disposed near headboard 28 of patient support system 22. Partially biased surface 52 enables the vertical ribs of side rail 26 to slip past truncated circular surface 56 at the extreme free end of elongated cylindrical member 40. As shown in FIG. 5 for example, the projection of the transverse cross-sectional area of the end of elongated cylindrical member 40 pictured in the foreground of FIG. 5, is designated by the numeral 54 in dashed line at its periphery. As shown in FIG. 5 for example, the plane which contains partially biased surface 52 extends at an acute angle from the plane which contains transverse cross-section 54 of elongated cylindrical member 40. This angle preferably is approximately 35°. The end of elongated cylindrical member 40 that defines partially biased surface 52 also further defines an extreme end portion 56, which is shaped as a partial circular surface. Extreme end portion 56 in effect defines a truncated circular surface. The truncated circular surface also is the area defined between the arcuate portion of the circle and a chord, also known as a segment. The shape of partially biased surface 52 resembles a truncated oval surface disposed at an acute angle from the plane which includes extreme end portion 56.

In further accordance with the patient comfort apparatus of the present invention, the elongated cylindrical member can define an appendage which extends from the elongated cylindrical member in a direction transversely to the longitudinal axis of the elongated cylindrical member. The appendage preferably extends along substantially less than the full length of the elongated cylindrical member. In one embodiment of the present invention, a truncated cylindrical member is provided and disposed adjacent to but separate from the elongated cylindrical member. Otherwise, the appendage preferably defines a truncated cylindrical member which is integral with elongated cylindrical member 40. Moreover, in another alternative embodiment, the truncated member and the elongated cylindrical member to which it is appended, can be formed as a unitary structure. As embodied herein and shown in FIG. 5 for example, a truncated member 46 forms an appendage of elongated cylindrical member 40. Truncated member 46 defines a second longitudinal axis extending along the length of truncated member 46 and preferably disposed in a direction parallel to the longitudinal axis of cylindrical member 40. Furthermore, a second transverse axis extends perpendicular to the second longitudinal axis of truncated member 46. As shown in FIG. 5 for example, truncated member 46 defines a circular transverse cross-sectional area over the entire length of truncated member 46. Truncated member 46 preferably defines a second resiliently deformable member, which can be formed of the same material that is used to form elongated cylindrical member 40. As shown in FIG. 3 for example, truncated member 46 defines an oval-shaped transverse cross-sectional shape over the entire length of truncated member 46. Other transverse cross-sectional shapes for truncated member 46 also can be provided. However, like elongated cylindrical member 40, it is preferred to provide a transverse cross-sectional shape having a linear axis of symmetry in one direction, such as the oval shape shown in FIG. 3 for example. The major axis of the oval is the desired linear axis of symmetry. Moreover, as shown in FIGS. 3 and 5 for example, truncated member 46 can define an elongated cylindrical cavity 48 extending longitudinally through at least a portion of the length of the second resiliently deformable member. Furthermore, truncated member 46 can define an elongated solid member that is configured and disposed to fill at least a portion of elongated cylindrical cavity 48.

As shown in FIG. 5 for example, truncated member 46 preferably is disposed at a position intermediate along the length of elongated cylindrical member 40. As shown in FIGS. 1 and 2 for example, the truncated member preferably is disposed at a position along the length of the elongated cylindrical member so as to be in the immediate vicinity where the frame of the patient support system articulates. This articulatable vicinity of frame 38 is near where the diagonal ends of side rails 26 face off opposite one another on each side of patient support system 22. In this way, the truncated member which forms an appendage to elongated cylindrical member 40, provides an extra buffer to prevent a patient from inserting a limb into the space that can exist between the diagonal ends of adjacent side rails 26 in their raised position.

In still further accordance with the present invention, an outer cover is provided. As embodied herein an shown in FIGS. 3, 4, and 5 for example, a cover 50 surrounds elongated cylindrical member 40 and truncated member 46 by defining a cavity for receiving elongated cylindrical member 40 and truncated member 46 within cover 50. The cover is impervious to liquid and preferably is formed as a flexible web of polyurethane coated nylon web material. Cover 50 preferably defines the outermost covering of elongated cylindrical member 40 and adjacently disposed truncated member 46. Cover 50 preferably defines a continuous flexible web that is shaped to conform closely to the shapes of the outer profiles of the adjacently disposed elongated cylindrical member and truncated member that are received within the cavity defined by cover 50.

In yet further accordance with the present invention, means are provided for connecting the elongated cylindrical member to the patient support system. As embodied herein and shown in FIGS. 3, 4, and 5 for example, the means for connecting the elongated cylindrical member to the patient support system preferably includes an attachment flange 58 mounted lengthwise along cover 50. Preferably, attachment flange 58 and cover 50 define a unitary member. As shown in FIGS. 3, 4 and 5 for example, attachment flange 58 defines a plurality of holes 62 spaced apart along the length of flange 58. The circumference of holes 62 is preferably not reinforced by a metal ring or other rigid reinforcing material. Such rigid materials could prove discomfortable or injurious to a patient. As shown in FIG. 5 for example, attachment flange 58 defines a flexible hinge portion 60 that is disposed between cover 50 and the portion of flange 58 through which holes 62 are defined. Thus, attachment flange 58 provides means for attaching cover 50 to the patient support system.

In further accordance with the present invention, means are provided for gaining access into the cavity of the cover. As embodied herein and shown in FIG. 2 for example, the means for gaining access into the cavity of the cover includes an access opening defined in cover 50. As shown in the embodiment of FIG. 2 for example, the access opening is defined by a line designated 64 and another line designated 66. Each said access opening 64, 66 respectively permits selective insertion and withdrawal of elongated cylindrical member 40 and truncated member 46. Because FIG. 2 illustrates a view at a considerable distance from the viewer, the detail of access opening 64 and 66 is not shown. However, suffice it to say that access openings 64, 66 define slits formed through cover 50 and are respectively surrounded by closure mechanisms (not shown) that are mounted about each access opening 64, 66. The closure mechanisms permit selective access to the respective access openings. The closure mechanisms are configured to be impervious to liquid when they are closed. Suitable closure mechanisms include a zipper or a hook and loop fastener mechanism.

In the embodiment shown in FIG. 2 for example, truncated member 46 defines a separate member from elongated cylindrical member 40 rather than a unitary or integral appendage to elongated cylindrical member 40. However, because of the ability of elongated cylindrical member 40 to deform its shape, in embodiments which include a unitary or integrated appendage forming truncated member 46, a single access opening 64 can suffice to permit selective insertion and withdrawal of such embodiment of the elongated cylindrical member.

In still further accordance with the present invention, a protective envelope is provided. As embodied herein and shown in FIG. 4 for example, a protective envelope 68 is disposed between cover 50 and elongated cylindrical member 40. Protective envelope 68 defines an encasement member that completely surrounds elongated cylindrical member 40. In embodiments in which truncated member 46 defines an appendage that is unitary or integral with elongated cylindrical member 40, protective envelope 68 also encompasses this appendage. However, in embodiments in which truncated member 46 defines a separate member from elongated cylindrical member 40, a second protective envelope can be provided to surround only truncated cylindrical member 46. The second protective envelope accordingly would form a skin type fit around truncated cylindrical member 46 and be disposed between truncated cylindrical member 46 and cover 50. Alternatively, protective envelope 68 can be configured to surround both elongated cylindrical member 40 and a separately defined truncated member 46 that is disposed adjacently with respect to elongated cylindrical member 40. Each protective envelope preferably includes an antibacterial agent. In one embodiment, a flexible liquid impervious material sold by Herculite Products Inc. of New York, New York under the trade name STAPHCHEK® forms protective envelope 68. The STAPHCHECK® material includes an antibacterial agent known as Captan: N-[(Trichloromenthyl) thio]-4-Cyclohexene- 1.2-Dicarboximide). The STAPHCHECK® material is a flexible continuous sheet of laminate vinyl-synthetic fabric that is wrapped tightly around elongated cylindrical member 40 and/or truncated cylindrical member 46 so as to conform closely to the shape(s) of the outer surfaces of such member(s).

What is claimed is:

1. A patient comfort apparatus for use with a low air loss patient support system having an articulatable frame and a plurality of inflatable sacks and side rails which raise and lower against the ends of the sacks, the apparatus comprising:

(a) an elongated cylindrical member,
  (i) said cylindrical member defining a resiliently deformable member, and
  (ii) said deformable member defining a first longitudinal axis extending along the length of said deformable member;
(b) an outer cover,
  (i) said cover surrounding said elongated cylindrical member,
  (ii) said cover defining a cavity for receiving said elongated cylindrical member,
  (iii) said cover defining a flexible web, and
  (iv) said cover being impervious to liquid; and
(c) means for connecting said elongated cylindrical member to the patient support system.

2. An apparatus as in claim 1, wherein:
(i) said deformable member having one end defining a partially biased surface.

3. An apparatus as in claim 1, wherein:
said means for connecting said elongated cylindrical member to the patient support system includes an attachment flange mounted lengthwise along said cover.

4. An apparatus as in claim 3, wherein:
(i) said attachment flange and said cover define a unitary member.

5. An apparatus as in claim 3, wherein:
(i) said attachment flange defining a flexible hinge portion.

6. An apparatus as in claim 1, further comprising:
(d) means for gaining access into said cavity of said cover.

7. An apparatus as in claim 6, further comprising:

(e) an appendage,
(i) said appendage extending from said elongated cylindrical-member in a direction transversely to said longitudinal axis, and
(ii) said appendage defining a truncated cylindrical member; and
(f) wherein:
said means for gaining access into said cavity of said cover includes an access opening defined in said cover,
(i) said access opening being configured and disposed to permit selective insertion and withdrawal of said elongated cylindrical member and said truncated cylindrical member.

8. An apparatus as in claim 7, wherein:
said means for gaining access into said cavity of said cover includes a closure mechanism mounted about said access opening and permitting selective access to said access opening,
(i) said closure mechanism being configured so as to be impervious to liquid when closed.

9. A patient comfort apparatus for use with a low air loss patient support system having an articulatable frame and a plurality of inflatable sacks and side rails which raise and lower against the ends of the sacks, the apparatus comprising:
(a) an elongated cylindrical member,
(i) said cylindrical member defining a resiliently deformable member, and
(ii) said deformable member defining a first longitudinal axis extending along the length of said deformable member;
(b) an outer cover,
(i) said cover surrounding said elongated cylindrical member,
(ii) said cover defining a cavity for receiving said elongated cylindrical member,
(iii) said cover defining a flexible web, and
(iv) said cover being impervious to liquid;
(c) means for connecting said elongated cylindrical member to the patient support system; and
(d) wherein:
(i) said elongated cylindrical member defining an appendage,
(ii) said appendage extending from said elongated cylindrical member in a direction transversely to said longitudinal axis, and
(iii) said appendage extending along substantially less than the full length of said elongated cylindrical member.

10. An apparatus as in claim 9, further comprising:
(d) a protective envelope,
(i) said protective envelope being disposed between said cover and said elongated cylindrical member,
(ii) said protective envelope completely surrounding said elongated cylindrical member, and
(iii) said protective envelope including an antibacterial agent.

11. An apparatus as in claim 9, wherein:
(i) said appendage defines a truncated cylindrical member,
(ii) said truncated member defining a second resiliently deformable member,
(iii) said truncated member defining a second longitudinal axis extending along the length of said truncated member, and
(vi) said truncated member being separable from said elongated cylindrical member.

12. An apparatus as in claim 11, further comprising:
(d) a protective envelope,
(i) said protective envelope being disposed between said cover and said elongated cylindrical member,
(ii) said protective envelope completely surrounding said elongated cylindrical member and said truncated cylindrical member, and
(iii) said protective envelope including an antibacterial agent.

13. An apparatus as in claim 9, wherein:
(i) said appendage being disposed at a position along the length of said elongated cylindrical member so as to be in the immediate vicinity where the frame of the patient support system articulates.

14. A patient comfort apparatus for use with a low air loss patient support system having an articulatable frame and a plurality of inflatable sacks and side rails which raise and lower against the ends of he sacks, the apparatus comprising:
(a) an elongated cylindrical member,
(i) said cylindrical member defining a resiliently deformable member,
(ii) said deformable member defining a first longitudinal axis extending along the length of said deformable member, and
(iii) said deformable member having one end defining a partially biased surface;
(b) an outer cover,
(i) said cover surrounding said elongated cylindrical member,
(ii) said cover defining a cavity for receiving said elongated cylindrical member,
(iii) said cover defining a flexible web, and
(iv) said cover being impervious to liquid;
(c) means for connecting said elongated cylindrical member to the patient support system; and
(d) wherein:
(i) said end of said deformable member which defines said partially biased surface further defining a first portion shaped as a truncated circular segment surface,
(ii) said circular segment surface being disposed transversely to said longitudinal axis,
(iii) said partially biased surface defining a second portion shaped as a truncated oval surface, and
(iv) said truncated oval surface being disposed at an angle relative to said longitudinal axis and connected to said truncated circular segment surface.

15. A patient comfort apparatus for use with a low air loss patient support system having an articulatable frame and a plurality of inflatable sacks and side rails which raise and lower against the ends of the sacks, the apparatus comprising:
(a) an elongated cylindrical member,
(i) said cylindrical member defining a resiliently deformable member, and
(ii) said deformable member defining a first longitudinal axis extending along the length of said deformable member;
(b) an outer cover,
(i) said cover surrounding said elongated cylindrical member,
(ii) said cover defining a cavity for receiving said elongated cylindrical member, (iii) said cover defining a flexible web, and
(iv) said cover being impervious to liquid; and
(c) means for connecting said elongated cylindrical member to the patient support system,
(i) said means for connecting said elongated cylindrical member to the patient support system including an attachment flange mounted lengthwise along said cover, and
(ii) said attachment flange defining a plurality of holes spaced apart along the length of said flange.

16. An apparatus as in claim 15, wherein:
(i) said flange defining a flexible hinge portion, and
(ii) said flexible hinge portion being disposed between said cover and said portion of said flange through which said holes are defined.

17. An apparatus for use with a low air loss patient support system having an articulatable frame and a plurality of inflatable sacks and side rails which raise and lower against the ends of the sacks, the apparatus comprising:
(a) an elongated cylindrical member,
(i) said cylindrical member defining a resiliently deformable member, and
(ii) said deformable member defining a first longitudinal axis extending along the length of said deformable member;
(b) a truncated cylindrical member,
(i) said truncated member defining a second resiliently deformable member,
(ii) said truncated member defining a second longitudinal axis extending along the length of said truncated member, and
(iii) said truncated member being disposed adjacent said elongated cylindrical member;
(c) an outer cover,
(i) said cover surrounding said adjacently disposed elongated cylindrical member and truncated member,
(ii) said cover defining a cavity for receiving said adjacently disposed elongated cylindrical member and said truncated member,
(iii) said cover defining a flexible web, and
(iv) said cover being impervious to liquid; and
(d) means for attaching said cover to the patient support system.

18. An apparatus as in claim 17, further comprising:
(e) a first protective envelope,
(i) said first protective envelope being disposed between said cover and said elongated cylindrical member,
(ii) said first protective envelope forming a skintight fit around said elongated cylindrical member, and
(iii) said first protective envelope including an antibacterial agent; and
(f) a second protective envelope,
(i) said second protective envelope being disposed between said cover and said truncated cylindrical member,
(ii) said second protective envelope forming a skintight fit around said truncated cylindrical member, and
(iii) said second protective envelope including an antibacterial agent.

19. An apparatus as in claim 17, further comprising:
(e) a protective envelope,
(i) said protective envelope being disposed between said cover and said adjacently disposed elongated cylindrical member and truncated cylindrical member,
(ii) said protective envelope forming a skintight fit around said adjacently disposed elongated cylindrical member and truncated cylindrical member, and
(iii) said protective envelope being formed of a material containing an antibacterial agent.

20. An apparatus as in claim 17, wherein:
(i) said elongated cylindrical member defines an elongated opening extending in the direction of said longitudinal axis.

21. An apparatus as in claim 17, wherein:
(i) said truncated cylindrical member defines an elongated opening extending in the direction of said second longitudinal axis.

22. An apparatus for use with a low air loss patient support system having a plurality of inflatable sacks and side rails which raise and lower against the ends of the sacks, carried by an articulatable frame, the apparatus comprising:
(a) an elongated cylindrical member,
(i) said cylindrical member defining a resiliently deformable member,
(ii) said deformable member defining a first longitudinal axis extending along the length of said deformable member,
(iii) said deformable member defining a transverse axis perpendicular to said longitudinal axis,
(iv) said deformable member defining a circular transverse cross-sectional shape over substantially the entire length of said deformable member,
(v) said deformable member having one end defining a partially biased surface,
(vi) said partially biased surface defining a first portion shaped as a truncated circular surface,
(vii) said truncated circular surface being disposed transversely to said longitudinal axis,
(viii) said partially biased surface defining a second portion shaped as a truncated oval surface,
(ix) said truncated oval surface being disposed at an angle relative to said longitudinal axis and connected to said truncated circular shaped surface,
(x) said deformable member defining an elongated cylindrical cavity extending longitudinally through at least a portion of the length of said deformable member,
(xi) said cylindrical member defining an elongated solid member configured and disposed to fill at least a portion of said elongated cylindrical cavity,
(xii) said cylindrical member defining an encasement member surrounding said deformable member,
(xiii) said encasement member defining a flexible continuous sheet wrapped tightly around said deformable member so as to conform closely to the shape of the outer surface of said deformable member,
(xiv) said encasement member being liquid impervious, and
(xv) said encasement member including an antibacterial agent;
(b) a truncated cylindrical member, (i) said truncated member defining a second resiliently deformable member, (ii) said truncated member defining a second longitudinal axis extending along the length of said truncated member, (iii) said truncated member defining a second transverse axis perpendicular to said second longitudinal axis, (iv) said truncated member defining a circular transverse cross-sectional shape over substantially the entire length of said truncated member, (v) said second resiliently deformable member defining an elongated cylindrical cavity extending longitudinally through at least a portion of the length of said second resiliently deformable member, (vi) said truncated member defining an elongated solid member configured and disposed to fill at least a portion of said elongated cylindrical cavity of said second resiliently deformable member, (vii) said truncated member defining a second encasement member surrounding said truncated member, (viii) said second encasement member defining a flexible continuous sheet wrapped tightly around said truncated member so as to conform closely to the shape of the outer surface of said truncated member, (ix) said second encasement member being liquid impervious, (x) said second encasement member including an antibacterial agent, (xi) said truncated member being disposed adjacent said elongated cylindrical member, (xii) said truncated member being disposed at a position intermediate along the length of said elongated cylindrical member, (xiii) said truncated member being disposed at a position along the length of said elongated cylindrical member so as to be in the immediate vicinity where the frame of the patient support system articulates, and (xiv) said truncated member being disposed with said second longitudinal axis of said truncated member being parallel to said first longitudinal axis of said elongated cylindrical member;

(c) an outer cover, (i) said cover defining a cavity for receiving said adjacently disposed elongated cylindrical member and said truncated member, (ii) said cover defining a flexible continuous web shaped to conform closely to the shape of the outer profile of said adjacently disposed elongated cylindrical member and said truncated member, and (iii) said cover being impervious to liquid;

(d) an access opening defined in said cover, (i) said access opening being configured and disposed to permit selective insertion and withdrawal of said elongated cylindrical member and said truncated member;

(e) a closure mechanism mounted about said access opening and permitting selective access to said access opening, (i) said closure mechanism being impervious to liquid when closed; and (f) an attachment flange mounted lengthwise along said cover, (i) said flange defining a plurality of holes spaced apart along the length of said flange, (ii) said flange defining a flexible hinge portion, (iii) said flexible hinge portion being disposed between said cover and said portion of said flange through which said holes are defined, and (iv) said flange and said cover define a unitary member.

* * * * *